United States Patent [19]

Rilly et al.

[11] Patent Number: 4,586,016

[45] Date of Patent: Apr. 29, 1986

[54] HIGH VOLTAGE TRANSFORMER FOR DEFLECTION OF ELECTRON BEAMS

[75] Inventors: Gerard Rilly, VS-Pfaffenweiler; Gerard Morizot; Daniel Lopez, both of Villingen-Schwenningen; Erich Weisser, Mönchweiler, all of Fed. Rep. of Germany

[73] Assignee: Deutsche Thomson-Brandt GmbH, VS-Villingen, Fed. Rep. of Germany

[21] Appl. No.: 595,918

[22] Filed: Apr. 2, 1984

[30] Foreign Application Priority Data

Mar. 31, 1983 [DE] Fed. Rep. of Germany ..... 3311775

[51] Int. Cl.[4] ..... H01F 27/02; H01F 27/30; H01F 41/02

[52] U.S. Cl. ..... 336/96; 29/602 R; 29/606; 264/272.19; 336/205; 336/198

[58] Field of Search ..... 336/96, 205, 198, 208, 336/185; 264/272.19; 29/605, 606, 607, 608, 602 R

[56] References Cited

U.S. PATENT DOCUMENTS

| | | | |
|---|---|---|---|
| 3,236,937 | 2/1966 | Harkness et al. | 264/272.19 X |
| 3,265,998 | 8/1966 | Park | 336/96 X |
| 4,156,221 | 5/1979 | Graul | 336/96 X |
| 4,204,263 | 5/1980 | Onoue | 336/185 X |
| 4,318,067 | 3/1982 | Weiner | 336/198 X |
| 4,334,206 | 6/1982 | Nakamura | 336/198 X |
| 4,408,176 | 10/1983 | Nakamura | 336/198 X |

FOREIGN PATENT DOCUMENTS

| | | | |
|---|---|---|---|
| 1529136 | 10/1978 | United Kingdom | 336/198 |

*Primary Examiner*—Thomas J. Kozma
*Attorney, Agent, or Firm*—Horst M. Kasper

[57] ABSTRACT

A high voltage transformer is provided for the voltage employed in the line deflection of an electron beam in a television receiver. The secondary high voltage winding is inserted into a case via an opening running parallel to the axis of the primary and secondary winding and is disposed in the case separate from the primary winding and is surrounded by a cast plastic resin. Preferably, the secondary winding body snaps into elastically supported protrusions disposed at the case. The plastic resin is filled into position through said opening. The high voltage connection is immersed into the plastic resin and is then led outwardly.

18 Claims, 3 Drawing Figures

1
2
3
4
5
6
7
8
9
10
11
12
13
16
17
18
19
20
21

HIGH VOLTAGE TRANSFORMER FOR DEFLECTION OF ELECTRON BEAMS

BACKGROUND OF THE INVENTION

1. Field of the Invention

The present invention relates to a transformer generating a voltage for the deflection of electron beams, for the generation of a high deflection voltage, as well as for a voltage for focussing the electron beams in a picture tube of a television receiver.

2. Brief Description of the Background of the Invention Including Prior Art

Transformers are employed to effect a the change in voltage in alternating electrical power sources. The primary winding as well as some auxiliary windings are conventionally disposed on a first winding form and a high voltage winding for the generation of a high voltage is located at a second winding form disposed concentrically relative to the first winding form. The high voltage winding is fixed in position by casting around its a plastic resin.

Such transformers are known under the designation diode-split-transformer. They comprise a primary winding with several auxiliary windings for the generation of several operating voltages. The windings are provided as aluminum foils with interposed insulating foils. Wire pieces protruding beyond the foil edge are welded on at the tapping points cross to the winding and the wire pieces run parallel to the axial direction of the winding form and lead at the end to a connector strip terminal.

The winding form providing the high voltage is subdivided into several winding chambers such that the winding can be subdivided into numerous winding sections. Diodes are connected between the winding sections such that the windings are connected in series via the diodes. High voltages result in connection with the winding length and winding capacity, which can be taken as high voltage or, respectively, focussing voltage for the picture tube of a television receiver. The two winding bodies are coaxially inserted and are supported in a case, where they are supported high voltage proof by filling in of an epoxy resin. The casting mass is filled into the case in parallel to the winding form axis from the connection side of the wires at the axial end of the winding form. The connections for the high voltage and the focussing voltage are led through the wall of the case near the opposite end of the case. In this connection the openings for the passage of the winding connections after the insertion of the connection wires have to be sealed carefully before the filling in of the synthetic plastic resin. This results in additional work expenditures as well as in a relatively high expenditure in costs and materials.

SUMMARY OF THE INVENTION

1. Purposes of the Invention

It is an object of the present invention to provide a simplified transformer for providing high voltages for electron beam control.

It is a further object of the present invention to provide a transformer where the high voltage wire connections are disposed remote from the magnetic core.

It is another object of the present invention to provide a simpler and less expensive method for the production of improved high voltage transformers.

These and other objects and advantages of the present invention will become evident from the description which follows.

2. Brief Description of the Invention

The present invention provides a transformer for generating a high voltage for control of an electron beam which comprises a second winding body including a secondary winding for providing a high voltage, a case surrounding the second winding and having an opening in an end wall located at a plane disposed parallel to the axis of the secondary winding for allowing the insertion of the second winding body into the case through the opening, an electrical connection for the second winding body and running through said opening, a first winding body comprising a primary winding disposed concentrically to the second winding body, and a cast of synthetic resin disposed in the case and surrounding the second winding body.

The first winding body can further comprise auxiliary windings. The first winding body can remain with its windings outside of the cast area. The first winding body is preferably inserted into the case and coaxially into the second winding body via the opening disposed in the wall of the case. Inwardly directed protrusions can be disposed at the edges of the openings in the end walls of the case and can provide a catch-locked position for the second winding body. Preferably, the inwardly directed protrusions are provided such that they act like a seal for the liquid plastic resins during filling of the case.

Electrical connections of the second winding body for the focussing voltage and the screen grid voltage can be furnished, which electrical connections are led outwardly through the plastic resin and which are adapted to be connected to a potentiometer unit. A ferrite core can be disposed inside of the primary winding. The ferrite core can comprise two sections, which are inserted into the primary winding from opposite sides in axial direction and which comprise yoke sections running outside of the case and joining together to provide a substantially continuous magnetic flux.

Preferably, the side walls are provided with the inside protrusions near the position of second winding for locking the second winding in position, which protrusions are elastically supported to allow for motion during the snap-in type insertion of the second winding body.

The synthetic resin can be a member of the group consisting of epoxide, polyvinyl chloride, polyethylene, polypropylene, crosslinked polyethylene, polytetrafluoroethylene, fluorinated ethylene propylene, polyvinyliden fluoride, silicone rubber, polychloroprene rubber, butyl rubber, polyurethane, polyamide, polyimide, polyester, polyalkene, polysulfone, and mixtures thereof. Preferably, the synthetic resin has a loss factor at 1000 Hertz of less than about 0.02 and preferably the dielectric strength of the synthetic resin is at least about 400 volts per millimeter.

There is also provided a method for the production of the high voltage transformers which comprises producing a second winding body to provide a high voltage, molding a case for supporting the second winding body, which has a side opening, inserting the second winding body into the case through the side opening, and filling the area around the second winding body inside the case with a synthetic resin material.

A first winding body can be inserted into the case and coaxially into the second winding body via an opening disposed in the wall of the case, and the first winding body further can include auxiliary windings. A magnetic yoke with a ferrite core can be inserted into the primary winding body, and preferably the magnetic yoke comprises two sections, which are inserted into the primary winding from opposite sides in axial direction and which comprise yoke sections running outside of the case and joining together to provide a substantially continuous magnetic flux.

The second winding body can be snapped-in over inwardly directed protrusions disposed at the edges of the openings in the end walls of the case near the position of second winding for locking the second winding in position, which protrusions are elastically supported to allow for motion during the snap-in type insertion of the second winding body. Electrical connections of the second winding body for the focussing voltage the screen grid voltage can be led outwardly through the synthetic plastic resin such that they can serve to be connected to a potentiometer unit. The case can be filled with liquid synthetic plastic resin while the inwardly directed protrusions act like a seal for the liquid plastic resin during filling of the case.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figures 1, 1A:
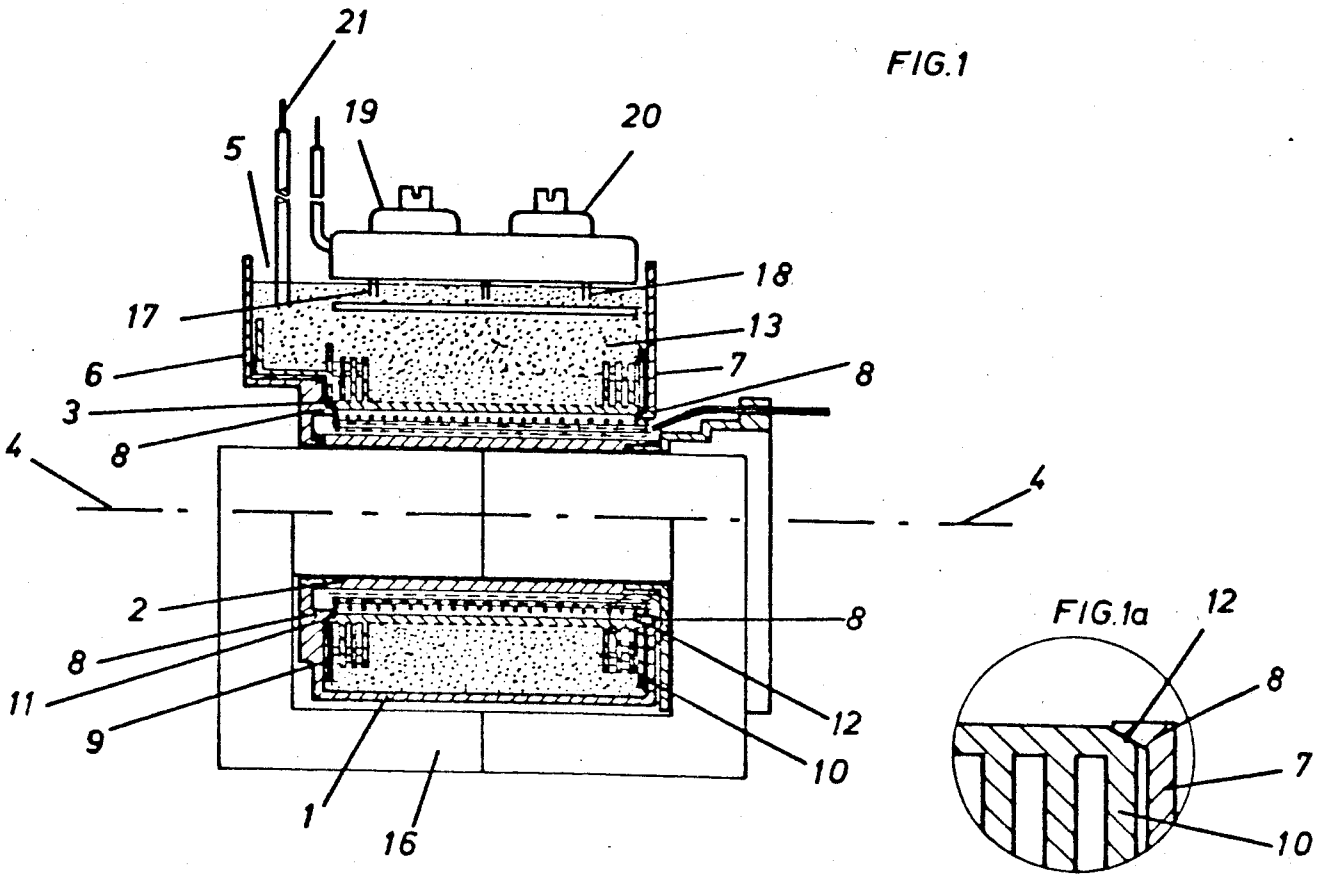
FIG. 1 is an in part sectional view of a transformer according to the invention.
FIG. 1*a* is a detail sectional view of the snap-in provision for placing the second winding form into the transformer case.

In accordance with the present invention there is provided a high voltage transformer for providing voltage for electron beam control, where the case 1 has an opening 2 in a plane parallel to the winding form axes 4. A second winding form 3 is inserted into the case 1 through the opening 5 and then synthetic plastic resin 13 can be filled into the case 1 through the opening 5. An electrical connection 21 of the winding applied to the winding form 3 is embedded in the plastic resin and led outward via the case opening 5.

The first winding form 2 can remain outside of the cast area with its windings and can be inserted through an opening 15 disposed in a side wall 7 of the case coaxially to the second winding body 3. The openings 14, 15 disposed in the side walls of the case are provided at their edges with inwardly directed protrusions 8, into which the second winding form 3 is snapped in. The snap-in attachment and connection can be furnished such that it provides a seal for the liquid synthetic plastic resin 13 during the filling process. Electrical connections for the focussing voltage and for the screen grid voltage can start at the winding form 3 and pass through the synthetic plastic resin to the outside and a potentiometer unit 19, 20 can be plugged onto these connections.

The case 1 is furnished such as to support the winding forms 2 and 3. The winding form 2 comprises a primary winding as well as several auxiliary windings. The winding form 3 supports the high voltage winding, which provides the anode voltage for the television picture tube and the focussing voltage as well as the screen grid voltage. An opening 5 is provided in the case 1 in a plane disposed in parallel to the joint axis 4 of the two winding forms 2 and 3. The winding form 3 can be inserted through this opening 5. The winding form 3 snaps into circular protrusions 8 coaxial to the axis 4 and disposed at the side walls 6 and 7 of the case 1. A sealing is furnished based on the elasticity of the side walls of the case 1, where the inclined and bevelled circular edges 11 and 12 at the flanges 9 and 10 of the winding form 3 are pressed against the protrusions 8.

After the winding form 3 with its windings is snapped into the case 1, the synthetic plastic resin 13 can be filled into the case 1 through the opening 5, where the synthetic plastic resin 13 surrounds the connection wire 21 led upwardly for the high voltage. Thus an additional opening to be sealed is not required for this high voltage connection. The winding body 2 for the primary winding is slid coaxially to the axis 4 into the case 1 through an opening 15 of the side wall 7 into a space, which is not filled by the synthetic plastic resin. The winding body 2 for the primary winding is disposed in the opposite side wall 6 of the case 1.

Finally, the ferrite U-core 16 is slid into the winding body 2 by passing through the openings 14 or 15 disposed in the side walls 6 and 7. The case 1 with its side walls 6 and 7 and supported by a support frame is tensioned such inwardly in the direction of the axis 4 during the filling in of the synthetic plastic resin that the circular protrusions 8 at the side walls are pressed against the edges 11 and 12 and thus a sealing is achieved, as is shown in the enlarged view of FIG. 1*a*. Connections 17 and 18 for the focussing voltage and the screen grid voltage are fed outwardly from the high voltage winding disposed on the winding body 3 through the synthetic plastic resin 13. The setting potentiometers 19 and 20 required for setting the recited voltages are advantageously provided as a unit with plug-in connections. Then the unit described can be adapted to various tube concepts by plugging in a corresponding potentiometer unit. The unit described entails the advantage that the winding form 2 can be exchanged and this way depending on the picture tube type a winding form 2 can be inserted specifically matching the picture tube type.

Figure 2:
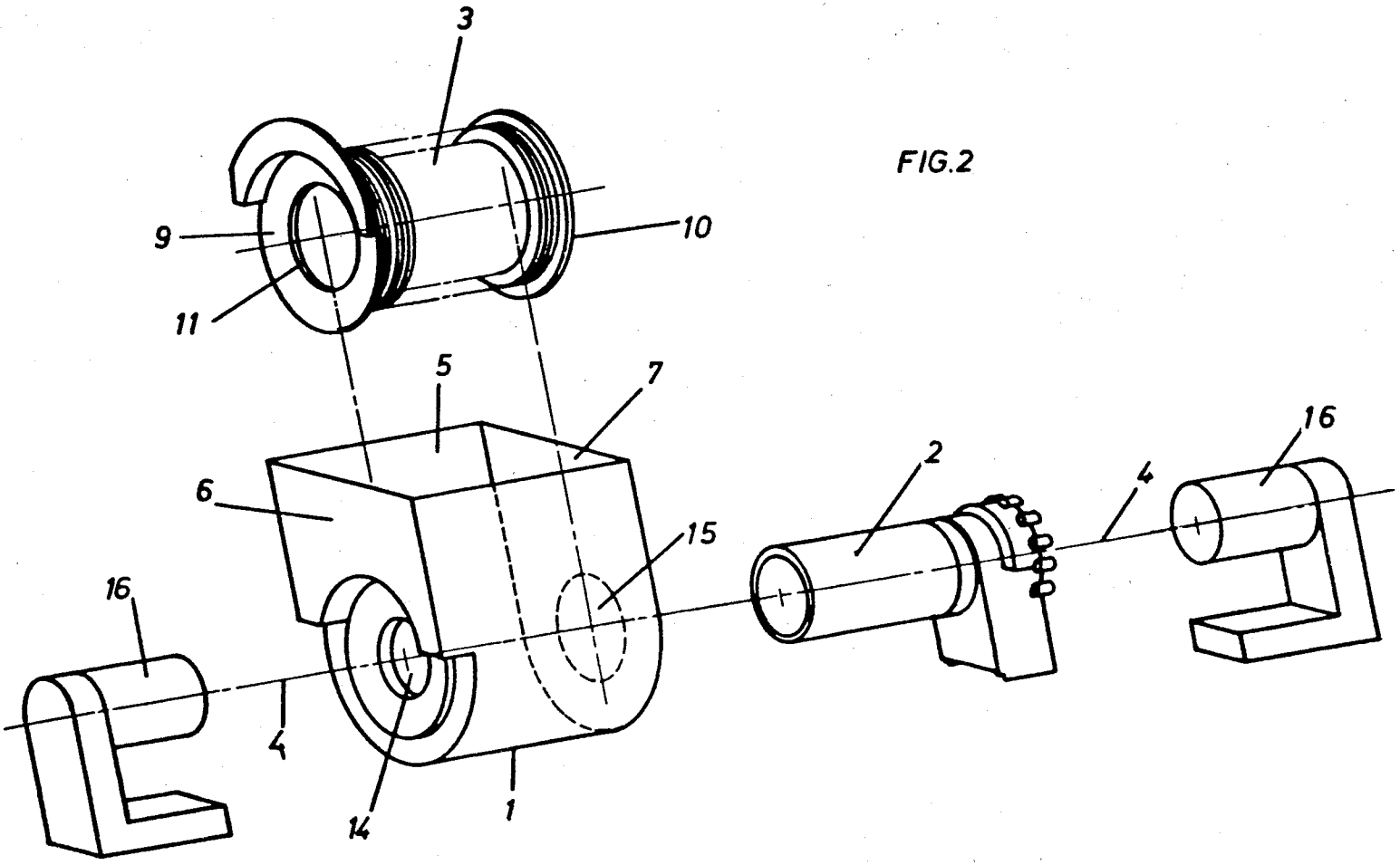
FIG. 2 is an exploded perspective view of the assembly parts of the invention transformer.

FIG. 2 shows a perspective exploded view of the components employed. The winding from 3 can be substantially of cylindrical shape and the partial end flanges for providing a seal can be recognized. The two side walls of the case 1 can be of different configuration as shown. The primary winding form can be provided with an extension to allow for easy insertion into the openings of the case. The inner winding form can be provided with gripping provisions to allow a firm insertion. The magnetic core can comprise two equal parts where each part is inserted from one side of the case. Preferably the part section inserted into the winding form 2 is of cylindrical shape and the outside parts providing a closure of the magnetic circuit are preferably of rectangular configuration.

The case and the support parts of the winding forms can be made from a plastic material which has a low dielectric loss and a high electrical insulation strength. The windings are made from a metal of high metallic conductivity such as aluminum or copper. The magnetic core can be of a ferrite or other soft magnetic material.

It will be understood that each of the elements described above, or two or more together, may also find a useful application in other types of transformer system configurations and high voltage generating procedures differing from the types described above.

While the invention has been illustrated and described as embodied in the context of a high voltage transformer for deflection of electron beams, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A transformer for generating a high voltage for control of an electron beam comprising a second winding body comprising a secondary winding for providing a high voltage;

a case surrounding the second winding and having a second opening in an end wall located at a plane disposed parallel to the axis of the secondary winding for allowing the insertion of the second winding body into the case through the second opening;

an electrical connection for the second winding body and running through said second opening;

a first winding body comprising a primary winding disposed concentrically to the second winding body; and means on the edge of said second winding body providing a seal for the liquid plastic resin during filling of the case and preventing the resin from extending to the first winding body such that the first winding body can be exchanged or inserted into the second winding body;

a cast of synthetic resin disposed in the case and surrounding the second winding body.

2. The transformer for generating a high voltage according to claim 1 wherein the first winding body further comprises auxiliary windings.

3. The transformer for generating a high voltage according to claim 1 wherein the first winding body remains with its windings outside of the cast area.

4. The transformer for generating a high voltage according to claim 1 wherein said means comprises inwardly directed protrusions disposed in the end walls in axial direction of the case, which protrusions provide a catch-locked position for the second winding body.

5. The transformer for generating a high voltage according to claim 1 further comprising electrical connections of the second winding body for the focussing voltage and the screen grid voltage, which electrical connections are fed outwardly through the plastic resin and which are adapted to be connected to a potentiometer unit.

6. The transformer for generating a high voltage according to claim 1 further comprising a ferrite core disposed inside of the primary winding.

7. The transformer for generating a high voltage according to claim 6 wherein the ferrite core comprises two sections, which are inserted into the primary winding from opposite sides in axial direction and which comprise Ushaped sections running outside of the case and joining together to provide a substantially continuous magnetic flux.

8. The transformer for generating a high voltage according to claim 4 wherein the protrusions are elastically supported to allow for motion during the snap-in type insertion of the second winding body.

9. The transformer for generating a high voltage according to claim 1 wherein the synthetic resin is a member of the group consisting of epoxide, polyvinyl chloride, polyethylene, polypropylene, crosslinked polyethylene, polytetrafluoroethylene, fluorinated ethylene propylene, polyvinyliden fluoride, silicone rubber, polychloroprene rubber, butyl rubber, polyurethane, polyamide, polyimide, polyester, polyalkene, polysulfone, and mixtures thereof.

10. The transformer for generating a high voltage according to claim 1 wherein the synthetic resin has a loss factor at 1000 Hertz of less than about 0.02 and wherein the dielectric strength of the synthetic resin is at least about 400 volts per millimeter.

11. A method for the production of the high voltage transformers comprising producing a second winding body comprising a secondary winding to provide a high voltage; molding a case for supporting the second winding body which has a second opening in an end wall located at a plane disposed parallel to the axis of the secondary winding for allowing the insertion of the second winding body into the case through the second opening;

inserting the second winding body into the case through the second opening and where an electrical connection for the second winding body runs through said second opening; sealing means on the edge of said second winding body sealing said winding body against flow of the liquid plastic resin during filling of the case and preventing the resin from extending to a first winding body comprising a primary winding such that the first winding body can be exchanged or inserted into the second winding body; and filling the area around the second winding body inside the case with synthetic resin material.

12. The method for production of high voltage transformers according to claim 11 further comprising inserting a first winding body into the case and and coaxially into the second winding body via a first opening disposed in a wall located at an axial end of the case, wherein the first winding body further comprises auxiliary windings.

13. The method for the production of the high voltage transformers according to claim 12 further comprising inserting a magnetic ferrite U-core into the primary winding body, wherein the magnetic ferrite core comprises two U-sections, which are inserted into the primary winding from opposite sides in axial direction and which comprise magnetic ferrite U-core sections running outside of the case and joining together to provide a substantially continuous magnetic flux.

14. The method for the production of the high voltage transformers according to claim 12 further comprising snapping the second winding body over inwardly directed protrusions disposed at the edges of the openings in the end walls of the case near the position of second winding for locking the second winding in position, which protrusions are elastically supported to allow for motion during the snap-in type insertion of the second winding body.

15. The method for the production of the high voltage transformers according to claim 11 feeding electrical connections of the second winding body for the focussing voltage and the screen grid voltage outwardly through the plastic resin such that they can serve to be connected to a potentiometer unit.

16. The method for the production of the high voltage transformers according to claim 11 filling the case with liquid plastic resin while the inwardly directed protrusions act like a seal for the liquid plastic resin during filling of the case.

17. The method for the production of the high voltage transformers according to claim 11 wherein the synthetic resin is a member of the group consisting of eposide, polyvinyl chloride, polyethylene, polypropylene, crosslinked polyethylene, polytetrafluoroethylene, fluorinated ethylene propylene, polyvinyliden fluoride, silicone rubber, polychloroprene rubber, butyl rubber, polyurethane, polyamide, polyimide, polyseter, polyalkene, polysulfone, and mixtures thereof.

18. The method for the production of the high voltage transformers according to claim 11 wherein the synthetic resin has a loss factor at 1000 Hertz of less than about 0.02 and wherein the dielectric strength of the synthetic resin is at least about 400 volts per millimeter.

* * * * *